United States Patent [19]

Kearton et al.

[11] 4,350,162

[45] Sep. 21, 1982

[54] WOMEN'S BRASSIERS AND OTHER SIMILAR DRESS

[76] Inventors: Gloria M. Kearton; Malcolm C. Kearton, both of 27 Windermere Rd., Epping 2121, New South Wales, Australia

[21] Appl. No.: 884,201

[22] Filed: Mar. 7, 1978

[51] Int. Cl.[3] ..... A41C 1/14

[52] U.S. Cl. ..... 128/477; 128/510

[58] Field of Search ..... 128/477, 483, 484, 485, 128/510

[56] References Cited

U.S. PATENT DOCUMENTS

| | | | |
|---|---|---|---|
| 2,484,440 | 10/1949 | Witkower | 128/485 |
| 2,773,261 | 12/1956 | Schaumer | 128/484 |
| 3,115,141 | 12/1963 | Means | 128/484 |
| 3,306,299 | 2/1967 | Paramore | 128/510 |
| 3,459,190 | 8/1969 | Frischer | 128/483 |
| 3,527,231 | 9/1970 | Catanese et al. | 128/484 |

FOREIGN PATENT DOCUMENTS

| | | | |
|---|---|---|---|
| 217306 | 1/1958 | Australia | 128/477 |

*Primary Examiner*—Doris L. Troutman

[57] ABSTRACT

In the design of women's garments, the general intention is to improve and flatter the wearer's shape, specifically to the breast. This is mainly achieved by having a padded or stiffened contour brassiers, or alternatively a padded or stiffened platform upon which the breasts rest, to give to the wearer a pleasing contour.

5 Claims, 3 Drawing Figures

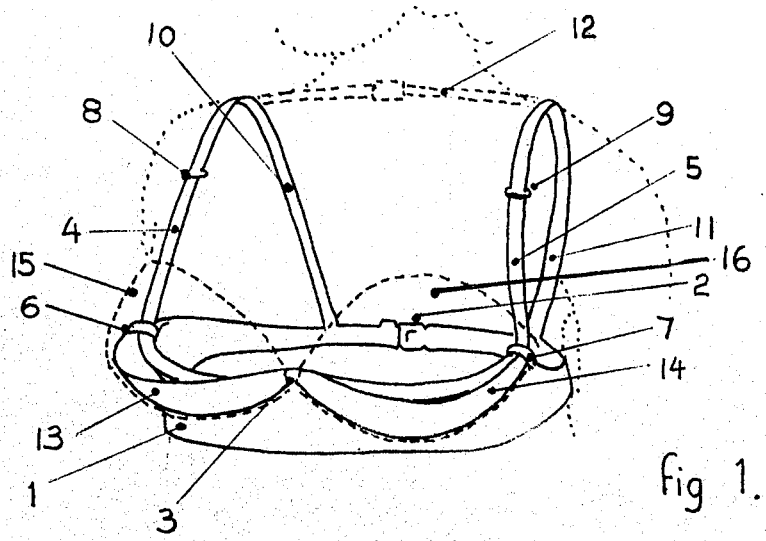
fig 1.
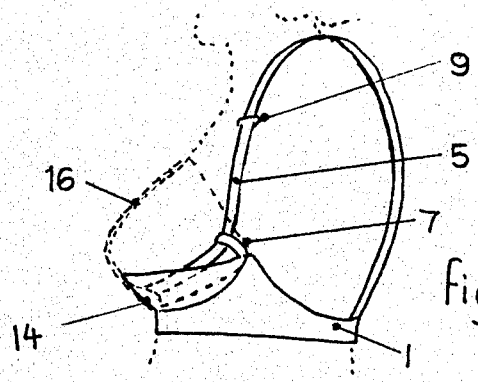
fig 2.
fig 3.
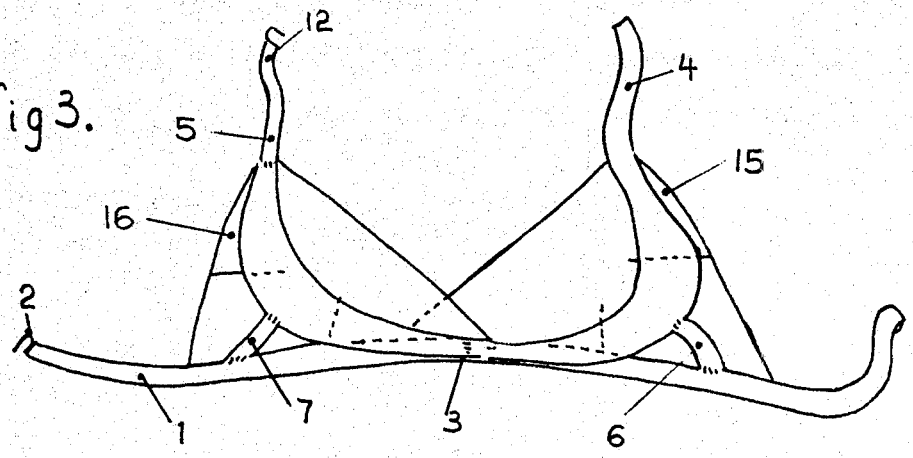

WOMEN'S BRASSIERS AND OTHER SIMILAR DRESS

The object of this invention is to provide a brassier in which the breasts are supported, giving a high full rounded appearance and above average comfort and freedom to the wearer. Since the breast is not encased in padding, the garment will not be so hot, thus discouraging excessive perspiration and the consequential weight loss in the area so covered. The said invention comprises a band of material worn below the breasts and fastened at the back, or at the front between the breasts. Attached to the centre of this band are two wide straps, resembling slings which lift each breast. These straps are passed through loops or anchored on the outside of the breast, the said loops or anchoring positions being secured to the band. The top of these straps pass over each shoulder to provide the upward support and are either seperately attached to the rear of the band, or to one another, behind the wearers neck, in what is known, as an "halter" neckline.

To aid the contouring and to give additional support to the breasts, two half moon shaped cups may be attached to the said band immediately below the breasts; these cups have sufficient stiffness to stand out from the breasts, and thus contour the underneath of the breasts, which have been raised by means of the two slings; alternatively, two contouring pieces of appropriately shaped and located material may be provided integral with or affixed one to each of the sling straps so that as well as being uplifted by the slings, the breasts are also contoured by the contouring pieces. When used in this specification and claims the word "contouring" means that any concavity or apparent falling away of the breast tissue on the outer side of the breasts which may appear consequent on the strong uplift of the sling straps, is minimised or altogether eliminated, thereby giving a full, attractive shape to the outer side of the breasts, as well as achieving a full, high appearance at the inner side or cleavage side of the breasts by the present invention. If desired the contouring pieces may be stiffened but this is not necessary to achieve a satisfactory contoured effect. To give a smooth contour under lightweight clothing, two shaped covers may be used to hide the breasts and to remove any sharp outline. Various embodiments of this invention are possible, such as the use of this principle in the design of foundation garments, beachwear, women's sports wear, dresses and other items of women's apparel.

Two embodiments of the present invention will now be described with reference to the accompanying drawings, in which FIG. 1 shows the construction of a brassier according to one embodiment of the invention, FIG. 2 shows a side view of the same embodiment indicating how it is worn, and FIG. 3 shows a second embodiment (viewed from the rear), of a brassier according to the invention.

In FIG. 1 which depicts a brassier constructed in accordance with the present invention, in which a band 1 manufactured out of some suitable material, which may be elastic, with a fastening 2 fits around the rib cage just below the breast. Fixed on this band, at a point between the breasts 3 are twostraps 4 and 5 which act as slings lifting each breast. To prevent the breasts from slipping from the slings, they are retained close to the band by loops 6 and 7, which are firmly attached to the said band 1. These loops 6 and 7 are positioned at the outside of the breasts. These straps 4 and 5 have adjustment at 8 and 9, are passed over the shoulders and can be fastened to the rear of the band at 10 and 11 or they can be fastened together behind the neck 12. To help contour and support the breasts two stiffened half moon shaped cup supports 13 and 14, are attached to the band 1 below the breast. To give a smooth appearance and to hide the breast two shaped covers 15 and 16 can be provided. Various decorations of lace or other motifs may be added. In other embodiments this sling strap principle of the present invention can be used built into other garments, for example dresses, sports wear, beachwear and foundation garments, hereinafter referred to as "other like support garments". Other embodiments can be described using the same construction but utilising other flexible materials, such as cloth of all types including nylon and acrylic materials, natural fibre cloths, such as rayon, wool, silk, cotton, or combinations thereof, plastic, rubber or plastic foam materials including polyvynolchloride, leather, fur or such type materials and in fact any flexible material, as long as the same principle of construction is adhered to.

The claims defining the invention are as follows:

1. An unwired brassiere or like support garment comprising:

a band of material encasing the chest just below the breasts, two sling straps being attached to said band at the centre thereof, said sling straps passing one under each breast and over the corresponding shoulder thereby lifting the breasts, said sling straps consisting of a wide flat ribbon, and having a further attachment to said band at a single point on the outside of each breast to prevent said sling straps from slipping from their position under the breast.

2. An unwired brassiere or like support garment according to claim 1 wherein said sling straps are fastened together in a halter-neck.

3. An unwired brassiere or like support garment according to claim 1 wherein said sling straps are fastened to said band at the back of the garment.

4. An unwired brassiere or like support garment according to claim 1, 2 or 3 further comprising means for contouring the breasts, said contouring means not contributing to the support of the breasts.

5. An unwired brassiere or like support garment according to claim 4 wherein said contouring means comprises two contouring pieces respectively attached one to each of said sling straps at the top of each breast.

* * * * *